United States Patent [19]

Ross

[11] Patent Number: 4,972,698

[45] Date of Patent: Nov. 27, 1990

[54] FEED STOCK CUTTING AND FORMING MACHINE

[75] Inventor: Philip J. Ross, Clearwater, Fla.

[73] Assignee: Sun Microstamping, Inc., Largo, Fla.

[21] Appl. No.: 386,410

[22] Filed: Jul. 27, 1989

[51] Int. Cl.[5] ..... B21D 7/00; B21D 28/00

[52] U.S. Cl. ..... 72/403; 72/339; 72/447; 72/453.01

[58] Field of Search ..... 72/403, 402, 394, 447, 72/446, 337, 339, 453.01, 472

[56] References Cited

U.S. PATENT DOCUMENTS

| | | | |
|---|---|---|---|
| 821,556 | 5/1906 | Vaughan | 72/402 |
| 973,167 | 10/1910 | Caswell | 72/447 |
| 2,918,100 | 12/1959 | Knox et al. | 72/403 |
| 3,256,915 | 6/1966 | Fisher, Jr. et al. | 72/403 |
| 3,440,859 | 4/1969 | Holtzhauer | 72/404 |
| 4,773,250 | 9/1988 | Miyazaki | 72/405 |
| 4,862,717 | 9/1989 | Dolliner | 72/403 |

FOREIGN PATENT DOCUMENTS

| | | | |
|---|---|---|---|
| 20403 | 10/1901 | United Kingdom | 72/403 |

*Primary Examiner*—Daniel C. Crane
*Attorney, Agent, or Firm*—Herbert W. Larson

[57] ABSTRACT

A vertically mounted working table has a centrally located forming station for making small parts from a feed stock. The forming station is located in a slide holder supported by a backer plate mounted on the working table. The slide holder has multiple radially directed slots for receiving slides containing a tool at one end. The slides are acuated by pneumatic cylinders through four way valves electrically controlled by cam actuated snap switches. The pneumatic cylinders can be repositioned in slots in the working table to change the stroke of the slide.

14 Claims, 9 Drawing Sheets

FEED STOCK CUTTING AND FORMING MACHINE

BACKGROUND OF THE INVENTION

1. Field of the Invention

This invention relates to automatic wire or strip stock cutting and forming machines More particularly, it refers to a vertically mounted air cylinder operated machine in which the stroke of each forming or cutting tool can be adjusted to provide for multiple products from one machine.

2. Description of the Prior Art

Wire cutting and forming machines are well known in the electrical connector art and are used to make connector elements of varying sizes, shapes and bends. U.S. Pat. No. 4,773,250 describes a module-type forming machine employing a central driving wheel gear with slide units operatively connected. These slides move in a radial direction towards and away from the forming station. Such a machine is expensive to build and although useful for varying operations, cannot be easily converted to a different bending or forming operation. A forming machine is needed which will perform several forming or cutting operations on thin wire or strip stock and be easily converted to produce wire pieces with a different configuration from the first set up operation.

SUMMARY OF THE INVENTION

I have invented a versatile cutting and forming machine of low relative cost which can be easily modified to change the work being done on a particular wire or strip stock which is generically called feed stock in this description.

My cutting and forming machine has a vertical plate or working table with a cutting and forming station centrally located on the working table. The forming station contains a backer plate mounted on the working table with a slide holder bolted to the backer plate. The slide holder has multiple radially directed slots into which slides containing a tool on one end move in a reciprocating motion. The slides are actuated by pneumatic cylinders controlled by a four way valve electrically actuated by cam programed snap switches. A stop on the outer edge of the slide holder controls the inward movement of each slide towards the forming station. The feed stock is advanced to the forming station by a feed stock advance apparatus attached to the working table.

The change in position and movement of each slide is controlled by the location of multiple slots in the working table. A cylinder bracket bolted to the air cylinder housing is bolted into the desired slot to correctly position the air cylinder which pneumatically drives a slide driver axially engaged to the slide. A different bending operation can be achieved merely by changing the position of the cylinder bracket in a working table slot changing the cams and changing the tool located at the end of the slide.

BRIEF DESCRIPTION OF THE DRAWINGS

The invention may be best understood by those having ordinary skill in the art by reference to the following detailed description when considered in conjunction with the accompanying drawings in which.

DETAILED DESCRIPTION OF THE INVENTION

Figure 1:
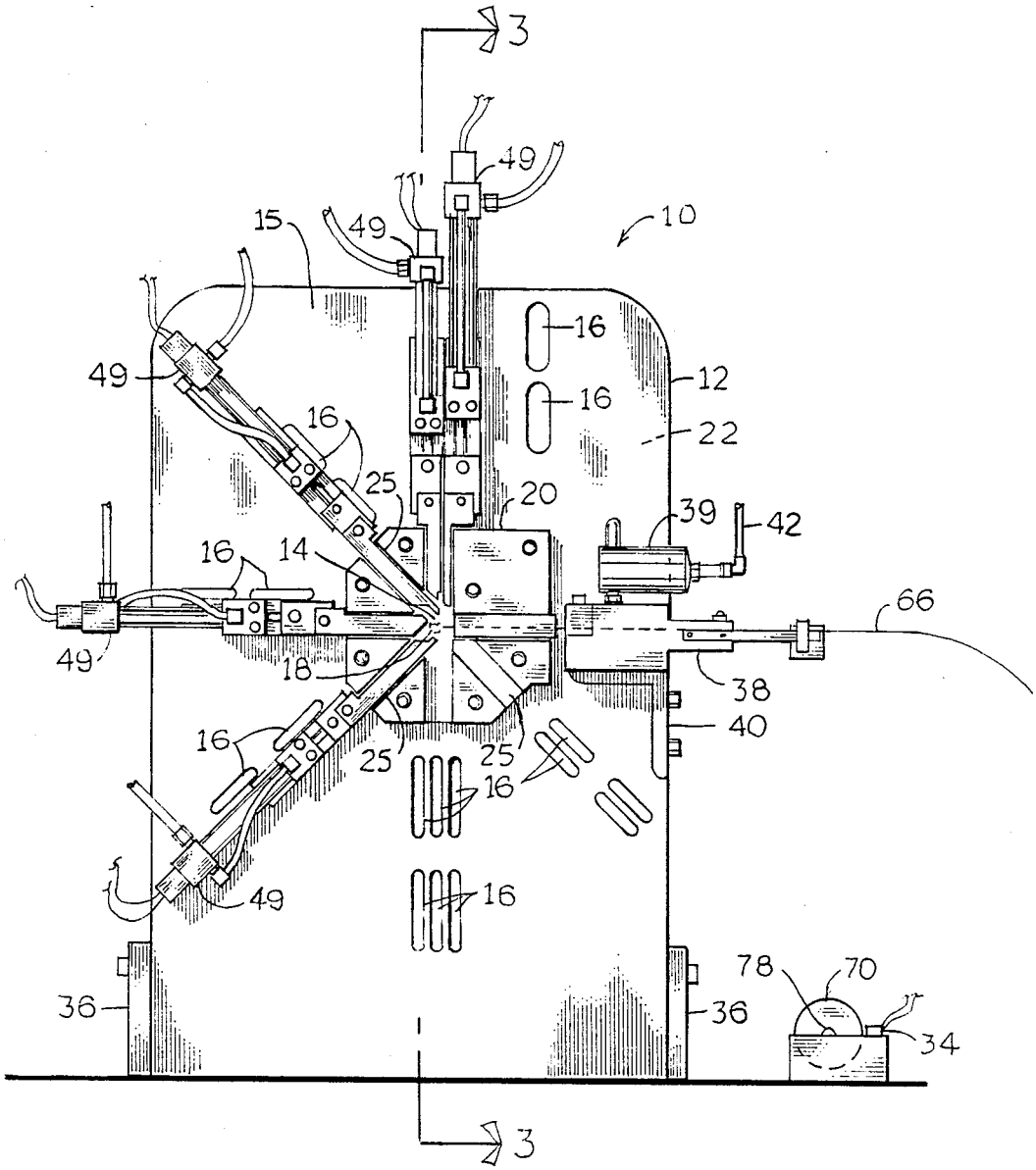
FIG. 1 is a front elevation view of an embodiment of the cutting and forming machine of this invention.

Throughout the following detailed description, the same reference numerals refer to the same elements in all figures.

Referring to FIG. 1 the forming machine 10 has a vertically mounted working table 12 with a forming station 14 centrally located on the work table. The working table 12 has a series of slots 16 distal from the forming station 14. A single slot 18 is located behind the forming station 14. The front portion 15 of the working table has a slide holder 20 centrally mounted on the front surface 15. The back surface 22 of the working table 12 has a single centrally located cylinder bracket 24 supporting an air cylinder 26 attached via four way valve 29 to an air feed line 28. The air feed line 28 is attached to an air manifold 30 activated through the wiring harness 32 connected to a snap switch 34. Each snap switch 34 is activated by a cam 70 driven on shaft 78 by motor 74.

The work table 12 is supported by support legs 36 on each side. A feed stock advance apparatus 38 is attached to the work table 12 by a mounting bracket 40. The feed stock advance station 38 is also fed via a four way valve 39 by an air line 42 which receives air from the air manifold 30.

Figure 2:
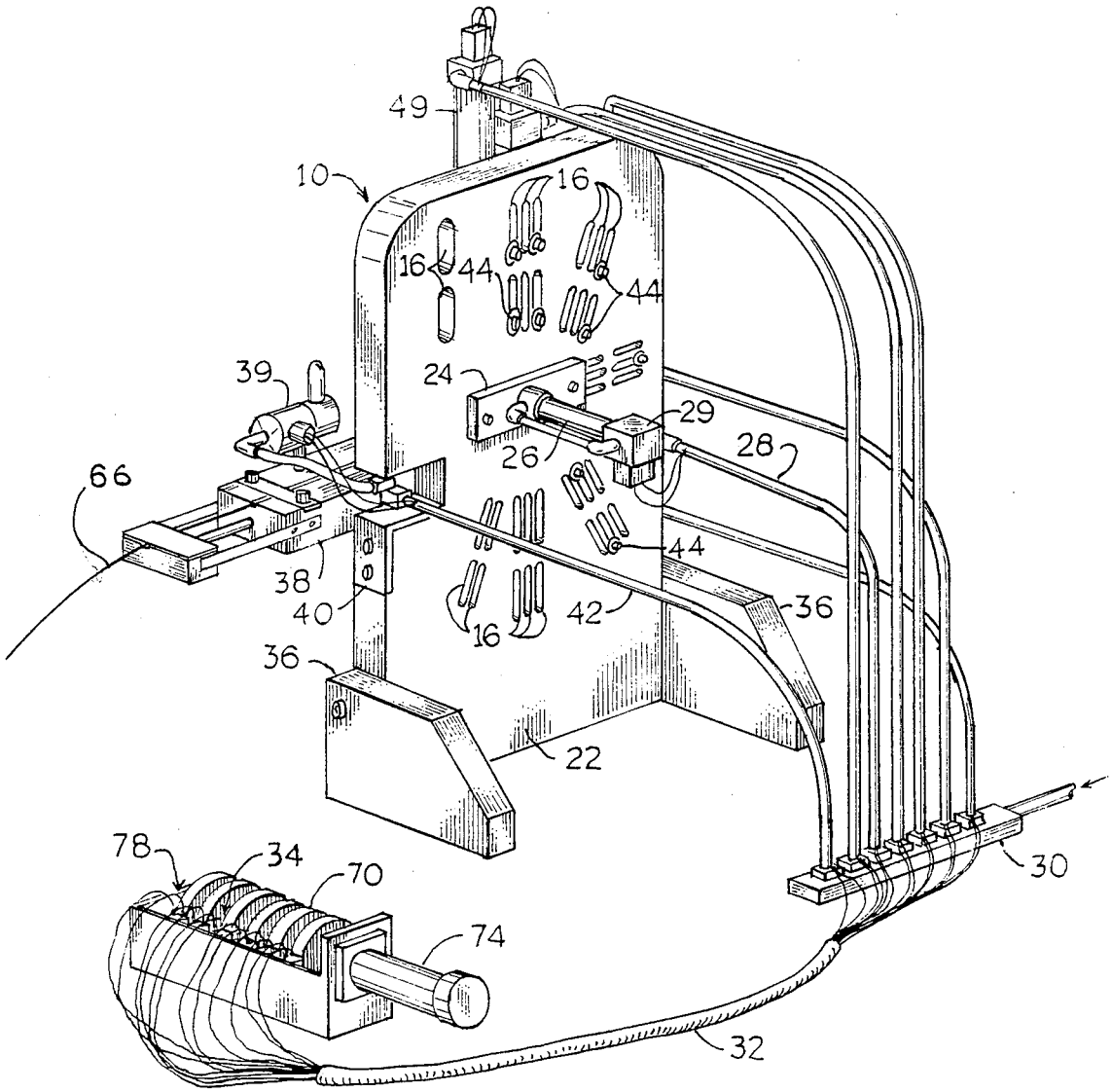
FIG. 2 is a rear perspective view of the cutting and forming machine.
Figure 3:
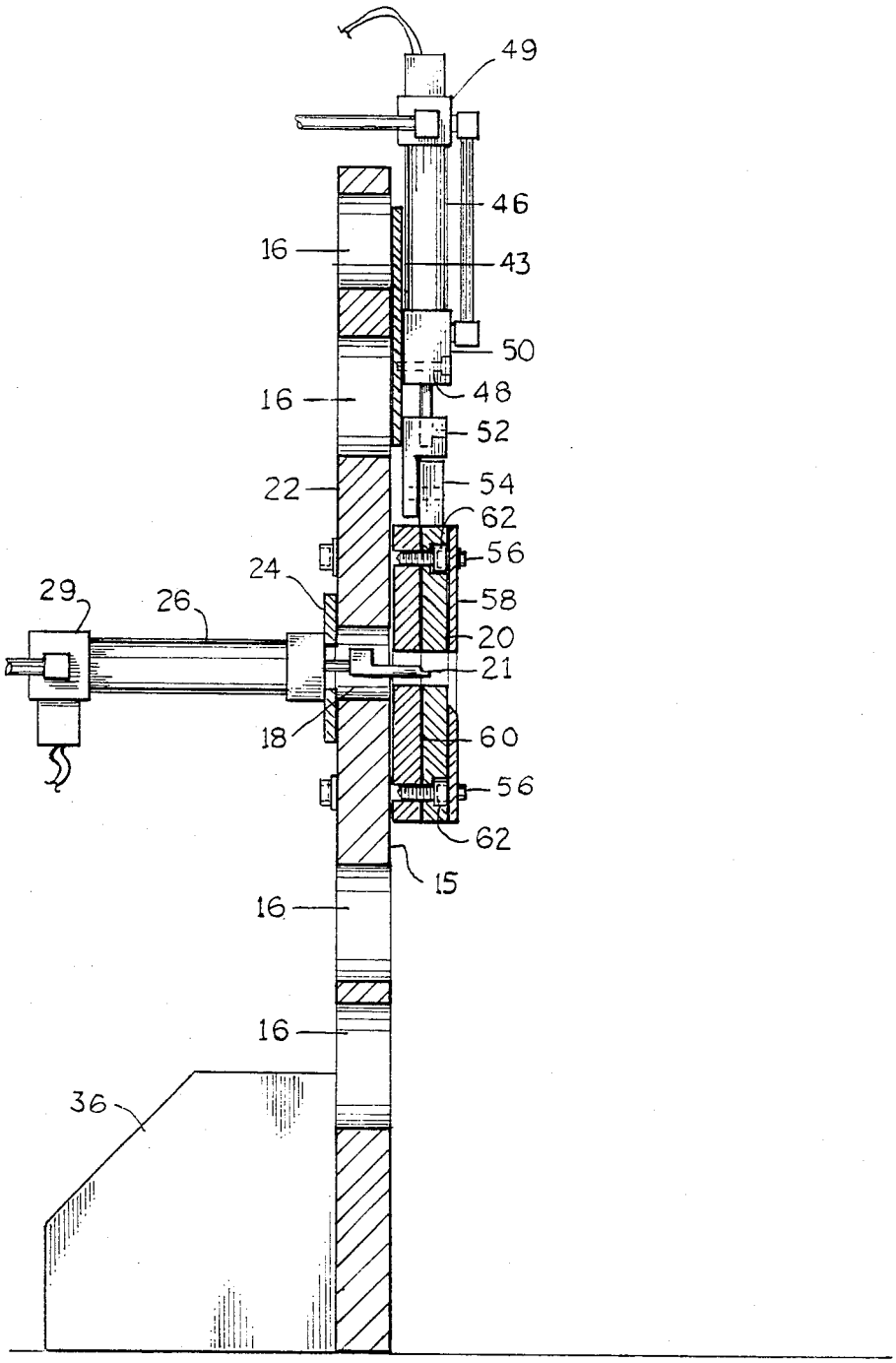
FIG. 3 is a side view of the cutting and forming machine along 3—3 of FIG. 1.

Referring to FIGS. 2 and 3 a cylinder bracket 43 is bolted through a slot 16 and held in place by bolts 44 to the rear 22 of the work table. An air cylinder 46 is attached to the cylinder bracket 43 by bolts 48. Air is received by air cylinder 46 through a four way valve 49.

Figure 5:
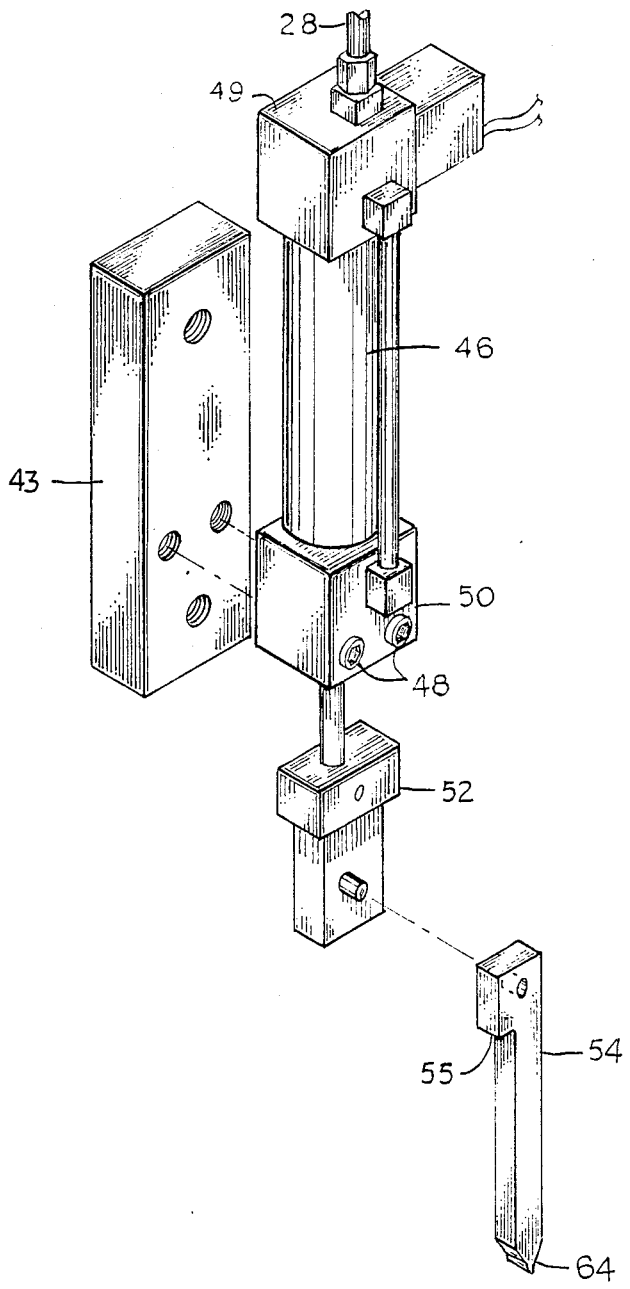
FIG. 5 is an exploded view of the air cylinder and its attachments to the slide or forming tool.
Figure 6:
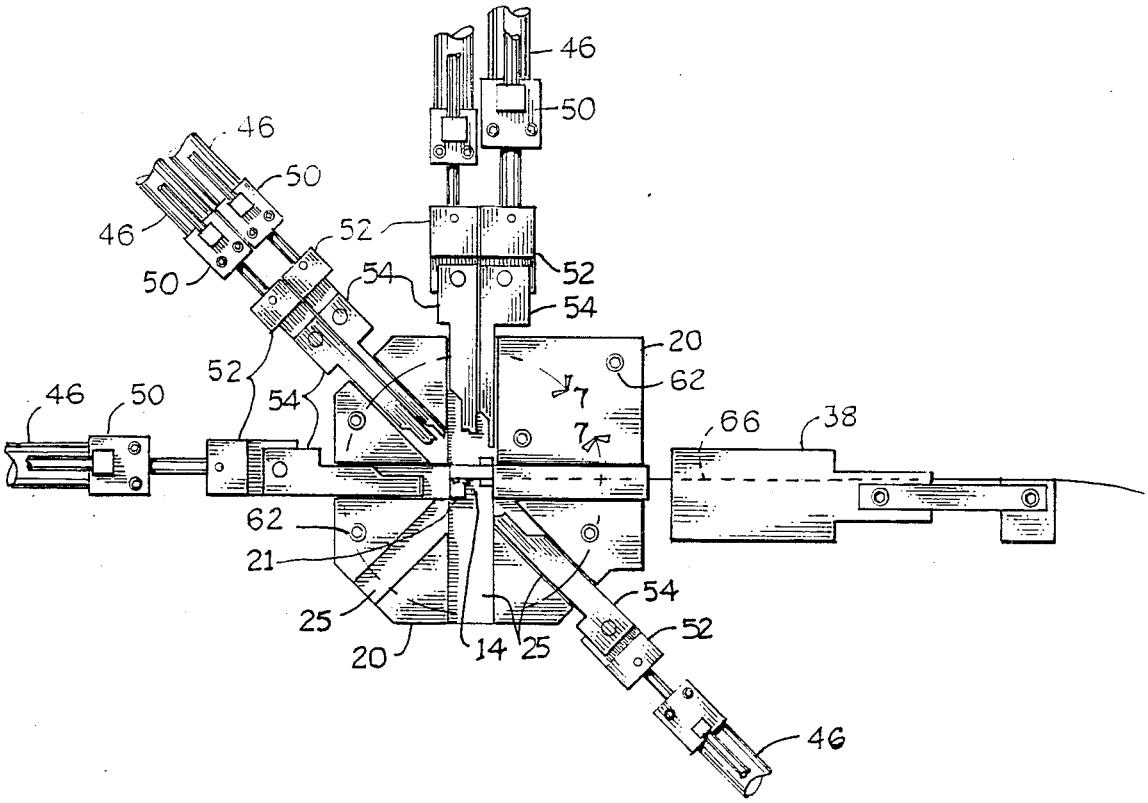
FIG. 6 is a front view of the forming station at the start of a stroke.
Figure 7:
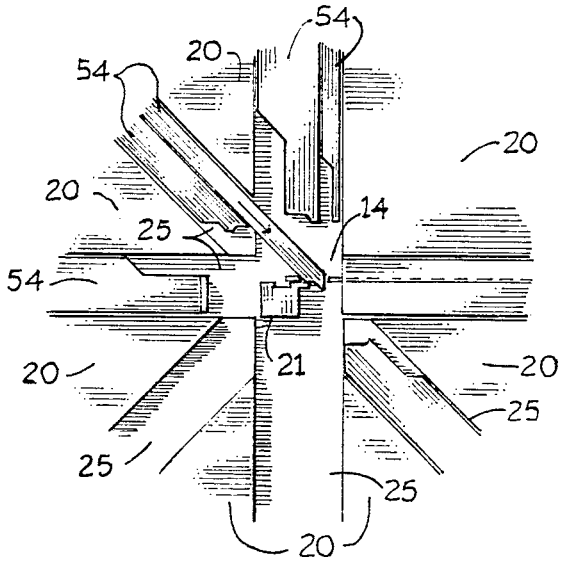
FIG. 7 is a front view of the forming station showing wire engaged by two tools.
Figure 8:
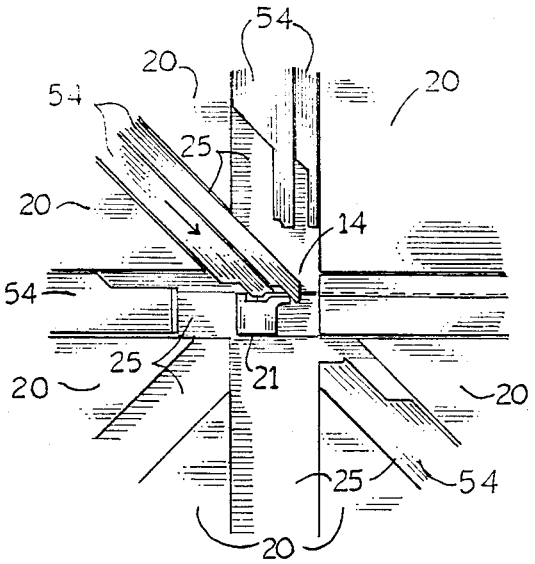
FIG. 8 is a front view of the forming station showing the next progressive step following the step of FIG. 7.
Figure 9:
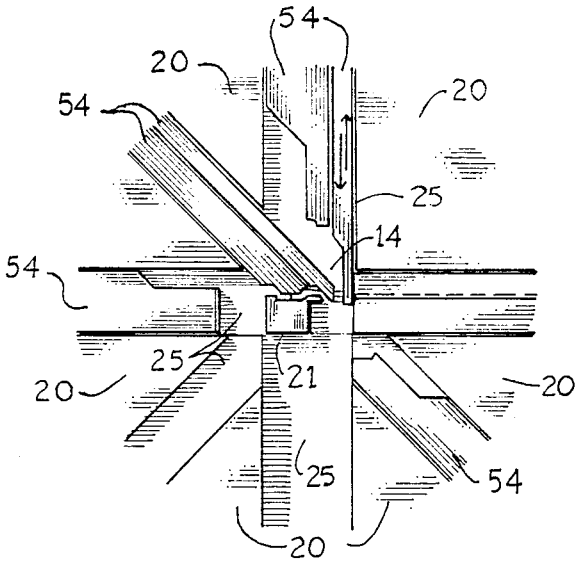
FIG. 9 is a front view of the forming station showing the next progressive step following the step of FIG. 8.
Figure 10:
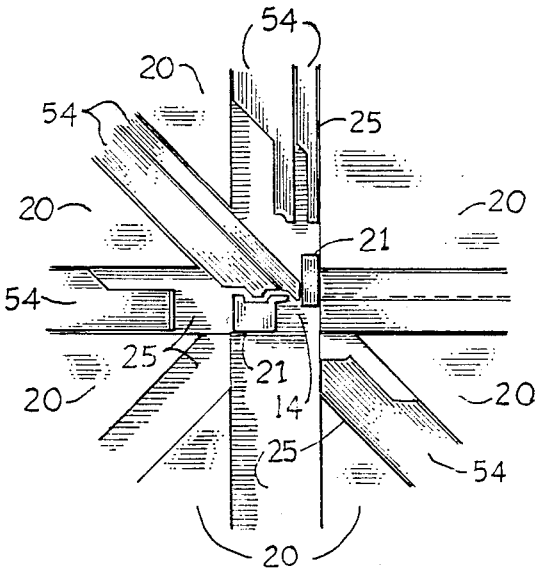
FIG. 10 is a front view of the forming station showing the next progressive step following the step of FIG. 9.
Figure 11:
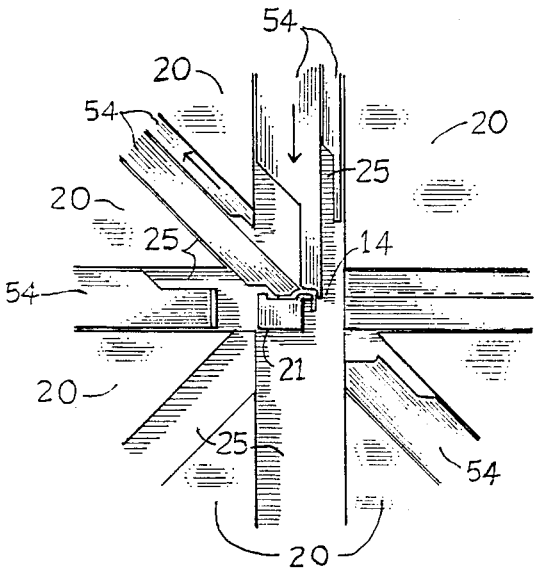
FIG. 11 is a front view of the forming station showing the next progressive step following the step of FIG. 10.
Figure 12:
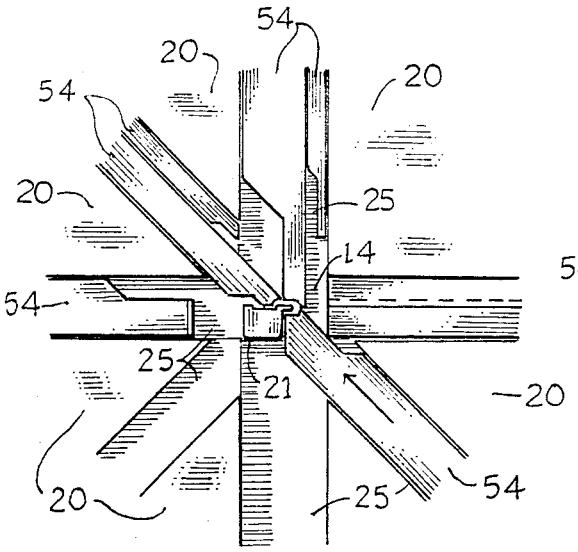
FIG. 12 is a front view of the forming station showing the next progressive step following the step of FIG. 11.
Figure 13:
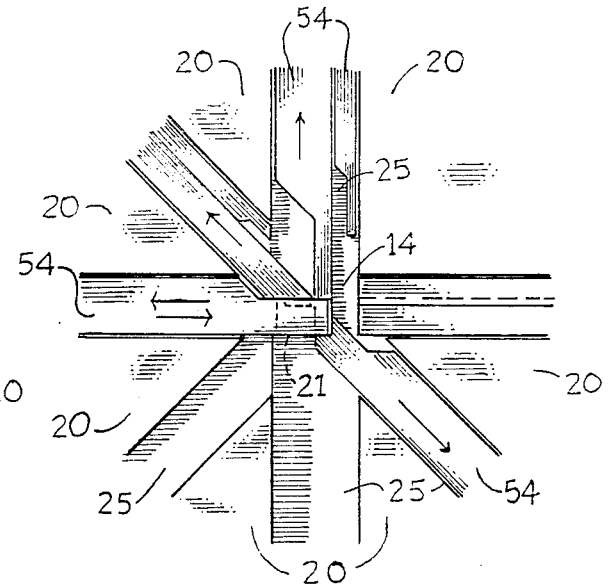
FIG. 13 is a front view of the forming station showing the slides retreating from the finished wire.

Depending from the air cylinder housing 50 is a slide driver 52 which is axially attached to the slide tool 54, as seen in FIG. 5. The slide 54 has a tool 64 at its end nearest the forming station 14. A stop 55 prevents movement of the slide 54 beyond a given distance , usually one inch, in slot 25.

Figure 4:
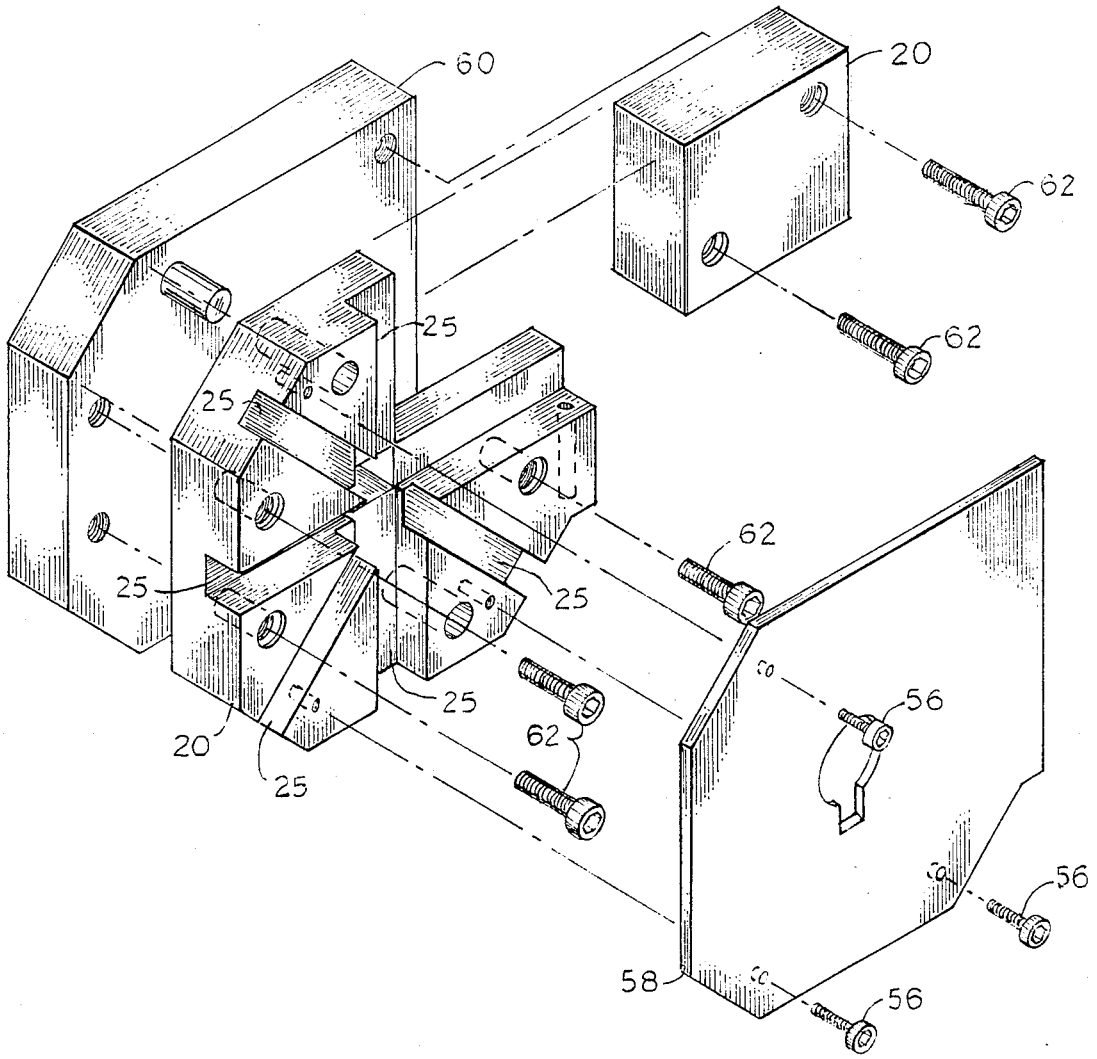
FIG. 4 is an exploded view of the forming station.

The air cylinder 46 is mounted so that it will be directed radially towards a slot 25 in the slide holder 20. The slide holder 20 is centrally mounted on the front surface 15 of the work table over a backer plate 60. As seen in FIG. 4, the backer plate 60 and slide holder 20, are attached by bolts 62 to the front 15 of the work table 12. The cover plate 58 is held in place by screws 56.

As seen in FIG. 3, a slide 21 is actuated by cylinder 26 mounted on a cylinder bracket 24 mounted on the rear 22 of working table 12. The slide 21 moves in a reciprocating fashion through hole 18 in a plane at right angles to the working table. The tool at the end of slide 21 can be used for cutting or providing a base for bending operations performed by other tools. It also can be used for ejecting the part.

Figure 14:
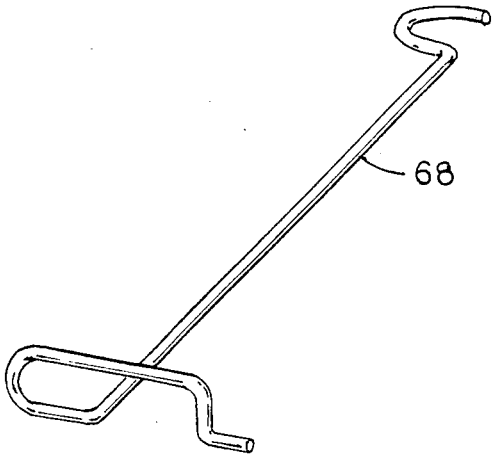
FIG. 14 is an enlarged view of the finished wire spring made from the steps shown in FIGS. 7–12.

As seen in FIGS. 6 through 13, the slides 54 radially move in and out in slot 25 based on their actuation in a radial direction toward the forming station 14 as the feed stock 66 is advanced from the feed stock advance unit 38. The varying tools will strike the feed stock 66 and either bend it or cut it as determined by the tool located at the end of the slide. Up to two slides may be located at each slot 25 for greater versatility in attacking the feed stock 66. The finished spring 68 as shown in FIG. 14 can have any shape depending upon the configuration of the tools located at the end of each slide 54. The feed stock 66 can be strip stock having up to a 0.5 mm thickness and width of up to 10 mm. The feed stock in the form of thin wire can have a diameter up to about 2 mm.

Figure 15:
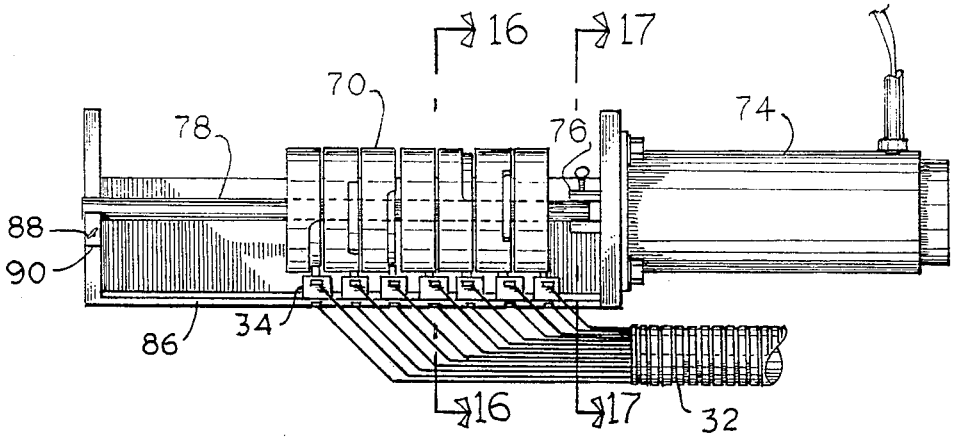
FIG. 15 is a top plan view of the cams and wiring harness for actuating the pneumatic cylinders.
Figure 16:
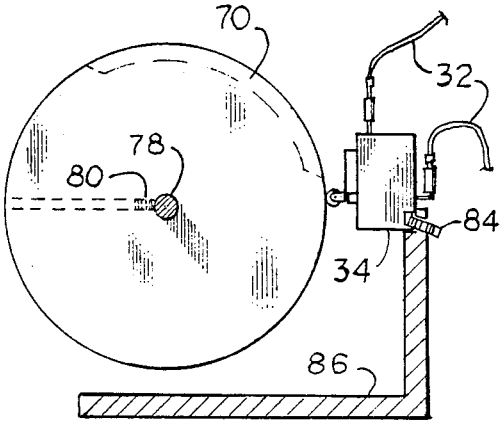
FIG. 16 is a side view of one of the cams along 16—16 of FIG. 15.
Figure 17:
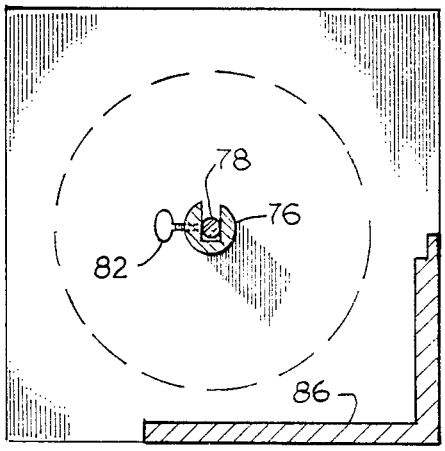
FIG. 17 is a side view of a shaft along 17—17 of FIG. 15 showing its method of mounting.

The wiring harness 32 connected to the snap switch 34 is seen in greater detail in FIG. 15. A nylon cable tie 84 ties the switch 34 to the switch housing 86. The cams 70 are located on the shaft 78 driven by a motor 74. The shaft 78 is keyed at 76 so that it can be easily removed and the cams 70 changed. Rotation of the cams 70 determine movement of the various slides on the surface of the work table.

A set screw 80 is used as a lock on shaft 78 while thumb screw 82 holds the shaft 78 in place. An end plate 90 locked in place by thumb screw 88 is opened when shaft 78 is to be removed so that cams 70 can be changed.

The arrangement of the cylinders driving each tool can be changed by merely unbolting the cylinder bracket from the working table and reconfiguring them in another slot. In this manner, the forming operation can be changed quickly so that a substitute product can be readily formed from the same machine. This ability to quickly change to a different operation facilitates an inexpensive way of producing connector parts, particularly in small quantities.

Although air cylinders are described in this invention, it is also possible that these cylinders can be hydraulically driven to exert additional force in the forming station. The air cylinders employed in this machine are operated at 80–100 psi and the slides exert about 1.38 pounds of force.

In addition to electrical connectors and small spring parts, the machine of this invention can be used to make small parts for the jewelry industry and other industries requiring small parts made from wire or strip stock.

Having thus described the invention, what is claimed and desired to be secured by Letters patent is:

1. In a cutting and forming machine having a working table with front and rear surfaces extending in a vertical plane and a cutting and forming station centrally located on the working table, a feed apparatus providing feed stock to the forming station, and a plurality of slides movable in slide receiving slots radially directed towards the forming station, the slides carrying forming too)s at their ends nearest the forming station and cooperating with the forming station, the improvement comprising;

multiple transverse slots located in the working table brackets located on the front surface of the working table at locations radially displaced from the forming station and secured to the table at selected transverse slots, each bracket having a power source attached thereto with a slide driven by the power source, a transverse slot located in the working table behind the forming station receiving a slide driven in a reciprocating motion towards and away from the front surface of the table by a power source mounted on a bracket on a centrally located rear surface of the working table, a slide holder separate from the brackets having attached power sources, mounted on a centrally located front surface of the working table, the slide holder containing the slide receiving slots and the forming station, a slide driver depending from each power source attached to respective slides, with each slide moving in a reciprocating motion within the slide receiving slot to form and cut feed stock fed into the forming station by the feed apparatus.

2. The machine according to claim 1 wherein the power source is an air cylinder.

3. The machine according to claim 2 wherein the air cylinders are actuated by four way valves, in turn actuated by multiple drum cams operating electric snap switches.

4. The machine according to claim 1 wherein each slide contains a stop to control a length of a stroke.

5. The machine according to claim 1 wherein two slides move within at least one slide receiving slot in the slide holder.

6. The machine according to claim 1 wherein the wire feed stock apparatus is attached to the working table.

7. The machine according to claim 6 wherein wire having a diameter less than 2 mm is employed in the feed stock apparatus.

8. The machine according to claim 6 wherein strip stock up to 0.5 mm thick and up to 10 mm wide is employed in the feed stock apparatus.

9. A cutting and forming machine with a working table having a front surface extending vertically, a centrally located, forming station and a plurality of slides supporting tools mounted in slide receiving slots radially directed towards the forming station, the machine also comprising, multiple transverse slots supporting air cylinders on the front surface of the working table at locations radially displaced from the forming station, each air cylinder driving one of the slides towards and away from the forming station, a transverse slot located in the working table behind the forming station with an air cylinder mounted on a rear surface of the working table to drive one of the slides towards and away from the forming station, a slide holder mounted on a centrally located front surface of the working table, the slide holder containing the slide receiving slots and the forming station, the air cylinders being mounted to the table separate from the slide holder, and multiple cams supported by a shaft removably mounted from a housing, each cam rotating to operate a switch to electrically signal the operation of an air source to each air cylinder.

10. The machine according to claim 9 having up to eleven air cylinders mounted on the working table.

11. The machine according to claim 9 wherein a feed stock apparatus moves feed stock to the forming station, the feed stock apparatus being operated by an air cylinder connected to an air source electrically connected to a switch operated by one of the cams.

12. The machine according to claim 11 wherein the feed stock is wire having a diameter less than 2 mm.

13. The machine according to claim 1 wherein the feed stock is metal strip stock having a width of less than 10 mm.

14. The machine according to claim 9 wherein the cam operated switch is a snap switch.

* * * * *